US005947471A

United States Patent [19]

De Ambrogio

[11] Patent Number: 5,947,471

[45] Date of Patent: Sep. 7, 1999

[54] DOCUMENT ALIGNING AND FEEDING DEVICE

[75] Inventor: Attilio De Ambrogio, Cigliano, Italy

[73] Assignee: Ing. C. Olivetti & C., S.p.A., Italy

[21] Appl. No.: 08/793,952

[22] PCT Filed: Jun. 28, 1996

[86] PCT No.: PCT/IT96/00134

§ 371 Date: Mar. 12, 1997

§ 102(e) Date: Mar. 12, 1997

[87] PCT Pub. No.: WO97/03008

PCT Pub. Date: Jan. 30, 1997

[30] Foreign Application Priority Data

Jul. 12, 1995 [IT] Italy ..... TO95A0588

[51] Int. Cl.[6] ..... B65H 5/02

[52] U.S. Cl. ..... 271/273

[58] Field of Search ..... 271/245, 273, 271/246

[56] References Cited

U.S. PATENT DOCUMENTS

| | | | |
|---|---|---|---|
| 2,446,211 | 8/1948 | Clark | 69/13 |
| 3,870,293 | 3/1975 | Simeth | 271/231 |
| 4,470,591 | 9/1984 | Acquaviva | 271/245 |
| 5,192,151 | 3/1993 | Mattila . | |

FOREIGN PATENT DOCUMENTS

| | | |
|---|---|---|
| 59-57843 | 4/1984 | Japan . |
| 2041277 | 9/1990 | Japan . |

*Primary Examiner*—William E. Terrell
*Assistant Examiner*—Kenneth W. Bower
*Attorney, Agent, or Firm*—Banner & Witcoff, Ltd.

[57] ABSTRACT

The document aligning and feeding device comprises couples of rollers formed by a delivery roller (15) and a backup counter-roller (14), wherein each couple of rollers is subjected to a lower load during the aligning step and a higher load during the successive feeding step. The backup counter-roller is formed by two separate, coaxially coupling counter-rollers, one of which (33) has a lower coefficient of friction with the document and is the one operating during the aligning step, whereas the other (31) has a higher coefficient of friction and is operational during the successive feeding step. This allows the document to rotate freely about one of its corners during the aligning step, and to advance without being deflected during the successive feeding step.

5 Claims, 2 Drawing Sheets

DOCUMENT ALIGNING AND FEEDING DEVICE

TEXT OF THE DESCRIPTION

1. Field of the Invention

The present invention relates to a device for equipment for the handling of documents such as, for example, printers, photocopiers, facsimile machines, accounting machines, etc., for aligning the document (such as, for example, a sheet of paper, a form, a magnetic card, a cheque, a bank passbook, etc.) against a movable stop and subsequently for feeding it in the direction of a document processing station (such as, for example, an impact printing station, an ink jet printing station, a thermal printing station, an optical or magnetic reading station, an OCR reading/writing station, an MICR reading/writing station, etc.).

2. Related Technological Art

Devices such as the above are known in the current art, generally comprised for example by a couple of shafts, set in rotation by a motor through gearwheels or timing belts, one of which (the delivery roller) bearing a series of delivery rollers having a high coefficient of friction, and the other (the back-up roller) bearing a corresponding series of counter-rollers. A load is applied between the rollers and counter-rollers, by a spring for example, so that the document inserted between the delivery rollers and back-up counter-rollers is gripped between the afore-mentioned and fed by the frictional force developed by the surface of the delivery roller pressed by the spring-generated load against one face of the document, until it comes to rest against a stop.

The stop normally has the dual purpose of registering the document, namely of establishing a certain geometrical or temporal correspondence between the document position and position of the following document processing station (in order to set correct printing start position in phase with an exact reference on the document for example), and that of aligning the document, namely of making the front leading edge of the document parallel to the working direction of the document processing station (in order to obtain alignment of the document with respect to the scanning position of a printhead, for example).

The need for the adjusting and aligning operations is due to the fact that the above-mentioned equipment permits insertion of documents by the operator without any binding orientation requirements so as to simplify the method of use and reduce the time spent by the operator in handling the document.

On closer examination of the document alignment and feeding operations, it will be noticed that, whereas the latter type operation requires a high frictional force (which depends on the load and on the coefficient of friction) between the document and the surface of both the delivery and backup rollers for delivery to be effected without slippage, in document alignment there is a conflicting requirement. In fact, if the leading end of the document is not parallel to the stop, the whole document will have to effect a rotation around the first corner to touch the stop, a rotation which implies slippage of the document with respect to both the delivery and backup rollers and which is easier to effect the lower the value of the frictional force referred to above.

A method known in the art for solving these conflicting requirements is that described, for example, in the U.S. Pat. application Ser. No. 5,192,151 filed by Mattila, wherein a device for feeding a document comprises a first shaft equipped with a plurality of delivery rollers, touching the underside of the document, and a second shaft equipped with a corresponding plurality of backup counter-rollers, for keeping the document pressed against the delivery rollers with a determined load.

The pressure of each of the backup counter-rollers against the corresponding delivery roller is provided by two separate helical springs, one of which more rigid than the other, mounted on a supporting mechanism on each of the backup rollers; the device also comprises a lifting mechanism by means of which action may be taken on the supporting mechanism to selectively release the more rigid spring, so that two different values for pressure between delivery rollers and backup rollers can be established, a higher value and a lower value.

Accordingly it is possible to effect the operation of aligning the document with respect to a stop, using the lower load between the rollers, and the operation of feeding after aligning, using the higher load. Unfortunately, this device is complex to build, requiring the use of a large number of parts, and also alters the frictional force between the aligning operation and the feeding operation only by acting upon the pressure between the rollers, without modifying the coefficient of friction between rollers and surface of the document.

SUMMARY OF THE INVENTION

One object of the present invention is therefore to define a document aligning and feeding device that is effective, yet simple and inexpensive to build.

Another object of the invention is to define a document aligning and feeding device comprising couples of rollers constituted by a delivery roller and a backup counter-roller, wherein each couple of rollers is subjected to a lower load during the aligning step and a higher load during the subsequent feeding step, and the backup counter-roller has a coefficient of friction with the document that is lower during the aligning step and a coefficient of friction that is higher during the subsequent feeding step.

A further object of the invention is to define a method for aligning and feeding a document, consisting in using an aligning and feeding device wherein couples of rollers comprising a delivery roller and a backup counter-roller are subjected to a lower load during the aligning step and a higher load during the subsequent feeding step, and the backup counter-roller has a lower coefficient of friction with respect to the document during the aligning step and a higher coefficient of friction during the subsequent feeding step.

A yet further scope of this invention is to define document handling equipment comprising a device for aligning and feeding said document and at least one station for processing said document, wherein said aligning and feeding device comprises couples of rollers composed of a delivery roller and a backup counter-roller, each couple of rollers being subjected to a lower load during the aligning step and a higher load during the subsequent feeding step, and the backup counter-roller has a lower coefficient of friction with the document during the aligning step and a higher coefficient of friction during the subsequent feeding step.

The above objects are achieved by means of a document aligning and feeding device, according to the main claim.

These and other objects, characteristics and advantages of the present invention will become apparent in the course of the following description of a preferred embodiment, provided as a non-exhaustive example, taken in conjunction with the accompanying drawings.

DETAILED DESCRIPTION OF THE PREFERRED EMBODIMENT

Figure 1:
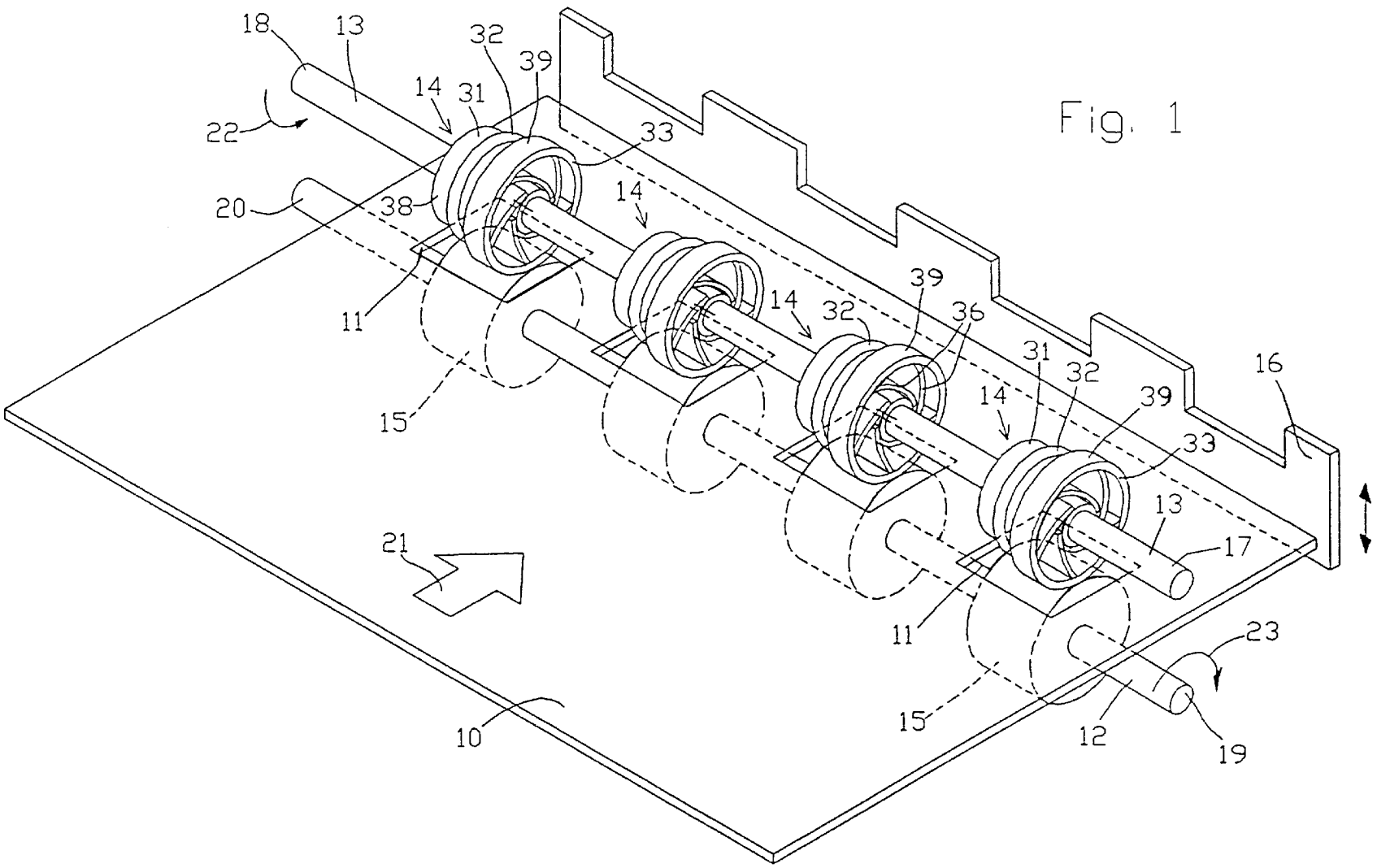
FIG. 1 is a perspective schematic view of the aligning and feeding device.

FIG. 1 illustrates schematically the document aligning and feeding device according to the present invention: it comprises a support and sliding plate 10 for positioning of a document (not shown in the figure), in which slots 11, of rectangular shape, for example, have been made.

A first shaft 12 bears, integrally attached to it, a plurality of delivery rollers 15 (4 are shown in the figure, but they may be more or less numerous) collaborating through the slots 11 with a corresponding plurality of backup counter-rollers 14, in turn integrally attached to a second shaft 13, to form couples of rollers.

A comb-shaped stop 16 is arranged on a plane substantially perpendicular to the support and sliding plate 10 and can move parallel to itself on said perpendicular plane, or can rotate through a fixed axis by the action of a simple mechanism not shown in the figure, to assume two distinct positions: a first position in which it is capable of intercepting and stopping a document advancing on the plate 10, and a second position in which it permits advancement of the document towards a subsequent processing station external to the device; it is additionally disposed parallel to the shafts 12 and 13.

The ends 19, 20 of the first shaft 12 and the ends 17, 18 of the second shaft 13 are supported through known type sliding means (not shown in the figure), such as, for example, bushings, ball bearings, etc., respectively on a fixed frame and a movable frame, not shown in the figure, by way of which a variable size load is applicable between the delivery rollers 15 and the backup counter-rollers 14. In addition, the shafts 12 and 13 selectively receive a rotating motion, respectively in the directions indicated by the arrows 23 and 22, generated by a motor external to the device, through known type transmission means (not shown in the figure), such as, for example, gearwheels, timing belts, etc.

Figure 2B:
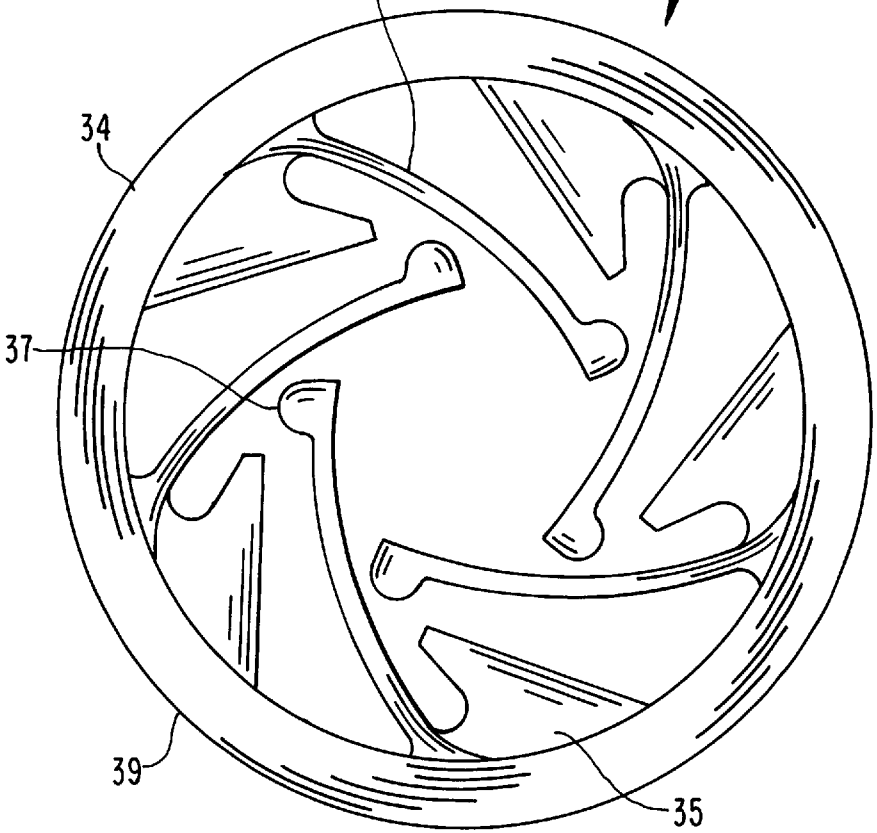
FIG. 2*b* is a front view of the second counter-roller.
Figure 2A:
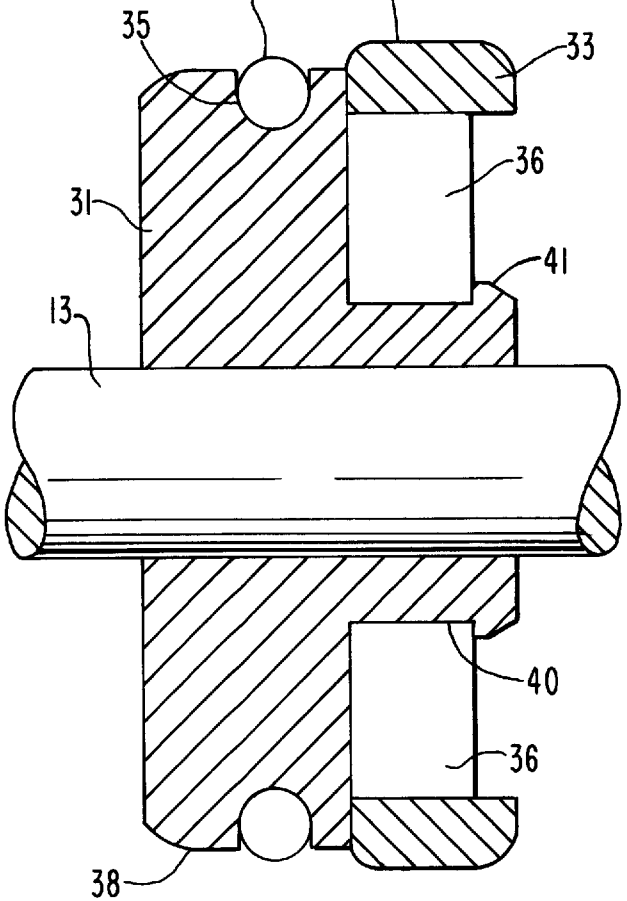
FIG. 2*a* is a sectional view of the backup counter-roller according to the invention, comprising the first and second counter-rollers.

The backup counter-rollers 14 (see FIG. 2*a*) are constituted by two coaxial elements: a first counter-roller 31 (made integral with the shaft 13 by way of known techniques, such as for example, driving, locking with pins, etc.), in the outer, rolling surface 38 of which a groove 35 is made for accommodating an O-ring 32, projecting slightly from the outer rolling surface 38, and thus defining a diameter of the first counter-roller 31, and which comprises a cylindrical sleeve 40; and a second counter-roller 33, fitted on the cylindrical sleeve 40 and kept in coupling contact with the counter-roller 31 by a system of resilient fingers 41 provided at one end of the cylindrical sleeve 40, capable of idling on the cylindrical sleeve 40 itself.

The second counter-roller 33 (see FIG. 2*b*) is formed by circular rim 34 from which a plurality of flexible spokes 36 extend towards the centre (5 are illustrated in the figure, but they may be more or less numerous); the ends 37 of the spokes 36 are arranged in a circumference such that, when the second counter-roller 33 is coupled with the first counter-roller 31, they are in contact but do not interfere with the outer surface of the cylindrical sleeve 36, and permit the second counter-roller 33 to rotate freely around the first counter-roller 31, as indicated previously. Also extending from the circular rim 34 towards the centre are projections 35, in like number to the spokes 36, constituting a stop for the spokes 36 should the latter be bent excessively.

The outer diameter of the second counter-roller 33, corresponding to an outer rolling surface 39 of the circular rim 34, is greater than the outer diameter of the first counter-roller 31, defined by the O-ring 32. The material from which the second counter-roller 33 is produced has a substantially negligible coefficient of friction with respect to the materials that the document is usually made of (paper, in most cases), unlike the material comprising the O-ring 32, which has a very high coefficient of friction.

The method of operation of the device shown in FIG. 1 during the document aligning step is as follows.

The operator puts a document in the device by placing it on the plate 10, according to the direction of arrow 21, without worrying about disposing its leading edge parallel to the movable comb-shaped stop 16, until it becomes inserted between the couples of rollers 15 and counter-rollers 14, and leaves it there; the couples of rollers 15 and counter-rollers 14, set in rotation according to the arrows 23 and 22 respectively by the motor external to the device, feed the document until one corner of the leading edge comes into contact with the movable stop 16, which is in a position to intercept the document as it moves on plate 10.

During this aligning step, a low value load is applied between the couples of rollers 15 and counter-rollers14, equivalent for example to that given substantially by the weight of the second shaft 13 alone (complete with the counter-rollers 14) and the document is fed by the frictional force developed by the delivery rollers 15 against the underside of the document, a frictional force which, because of the reduced load, is just sufficient to cause the document to slide on the plate 10. When the comer of the leading edge comes into contact with the movable comb-shaped stop 16, the document starts a rotation around the comer that brings the entire leading edge into contact with the movable stop 16.

As the load between the delivery rollers 15 and the backup counter-rollers 14 is low, the flexible spokes 36 of the second counter-roller 33 bend only slightly in the direction of the circular rim 34, so that the centre of rotation of the second counter-roller 33 is maintained substantially coincident with the geometric centre of the circular rim 34. Accordingly, the upper face of the document is in contact only with the rolling surface 39 of the second counter-roller 33, so that the document itself can slide reasonably freely against it during rotation about the front corner and, as the frictional force between the document and the counter-rollers 14 is low, no curling or deformation of the document occurs during this rotation.

Once the phase of aligning the document against the movable comb-shaped stop 16 is completed (alignment which may be verified using known techniques, by suitably arranging a microswitch or photoelectric sensor for example), the motion of shafts 12 and 13 is stopped and the load between the delivery rollers 15 and the backup counter-rollers 14 is increased, (for example, by applying a load between the fixed frame supporting the first shaft 12 and the movable frame supporting the second shaft 13, with the aid of resilient pressing means such as helical springs, leaf springs, etc.) with respect to that represented by the sole weight of the second shaft 13. This produces greater bending of the spokes 36 against the cylindrical sleeve 40 until the O-ring 32 is also brought into contact with the upper face of the document and the increased load with respect to the delivery rollers 15 is supported by the first counter-roller 31 and no longer by the outer rolling surface 39 of the second counter-roller 33.

The flexibility of the spokes 36 that support the circular rim 34, due to the reduction of the distance between the centre of rotation and the outer rolling surface 39 at the point of contact with the upper face of the document as the load is increased, results in the second roller 33 behaving as though its diameter varied in relation to the load applied, diminishing as the load is increased.

Subsequently the movable stop 16 is removed from the document path, by means of overturning or translational motion for example, and the shafts 12 and 13 are set in rotation again, in the directions indicated by the arrows 23 and 22 respectively, so that the document is fed in the direction indicated by arrow 21 towards a document processing station for subsequent operations to be effected.

During this feeding step, the document moves keeping its leading edge parallel to the shafts 22, 23, as it is gripped tightly between the delivery rollers 15 and the backup counter-rollers 14, with both the upper and underside faces of the document in contact with surfaces having a high coefficient of friction (respectively the O-ring 32 and the outer rolling surface of roller 15) and with a high load between the delivery rollers 15 and the backup counter-rollers 14, so that transveral slipping is impossible.

Naturally variants, additions or changes may be made to the present invention by persons skilled in the sector art.

For example, it is possible to use more than one couple of shafts bearing the delivery rollers and the backup counter-rollers; or the load between these couples of shafts may be varied between the aligning step and the feeding step by means of devices actuated by cam mechanisms; or again, the O-ring may be replaced by a coating on the outer rolling surface of the first counter-roller that has a high coefficient of friction.

In short, while adhering to the principle of this invention, details of the design and the forms of embodiment described and illustrated in the foregoing may be amply modified without exiting from the scope of the invention.

I claim:

1. A device for aligning and feeding a document, comprising:

a support;

stopping means provided for moving selectively between a first aligning position in which said stopping means intercepts said document while said document advances along said support, and a second feeding position in which said stopping means does not intercept said document, and thereby allow a further advancement of said document along said support;

a first shaft and a second shaft;

at least one couple of rollers provided for feeding said document along said support and formed by a delivery roller and a backup counter-roller between which said document is pressed, said delivery roller being supported by said first shaft, said backup counter-roller being supported by said second shaft said back up counter roller being comprised of a first counter-roller and a second counter-roller both mounted coaxially on said second shaft and having respectively a first circular portion and a second circular portion, said first circular portion being fixed rigidly with respect to the axis of said second shaft, the diameter of the second circular portion of said second counter-roller being greater than the diameter of the first circular portion of said first counter-roller, and moreover said first circular portion defining, when contacting the surface of said document, a first coefficient of friction which is greater than a second coefficient of friction defined by said second circular portion, when contacting said document;

loading means for variably urging said delivery roller and said backup counter-roller one against the other so as to activate a variable load between said delivery roller and said backup counter-roller; and resilient means, arranged between said second circular portion and the axis of said second shaft, for supporting said second circular portion on said second shaft, said resilient means allowing the axis of said second circular portion to displace, under a load, with respect to the axis of said second shaft;

whereby, when said stopping means are arranged in said first position and said at least one couple of rollers is subjected through said loading means to a first load, said backup counter-roller contacts said document, for advancing said document, only with said second circular portion having said second coefficient of friction, and accordingly said document, while being stopped by said stopping means, is allowed to slide with respect to said at least one couple of rollers and to shift angularly with respect to said stopping means, so as to assume a configuration aligned against said stopping means, and whereby, when said stopping means are arranged in said second position and said at least one couple of rollers is subjected to a second load by said loading means, greater than said first load, the axis of said second circular portion displaces with respect to said second shaft, so that said backup counter-roller contacts said document, for advancing said document, also with said first circular portion having said first coefficient of friction, and accordingly said document is fed beyond said stopping means without shifting angularly and sliding with respect to said at least one couple of rollers.

2. A device according to claim 1, wherein said resilient means comprise a plurality of elastically yielding spokes supporting said second circular portion on a cylindrical sleeve of said first counter-roller, said yielding spokes being capable of sliding with respect to said cylindrical sleeve.

3. A device according to claim 2, wherein said second counter-roller is further comprised of a plurality of projections which extend inwardly from said second circular portion and are in a like number to the yielding spokes, said projections being provided for stopping the spokes so as to limit their bending.

4. A device according to claim 2, wherein said first circular portion is formed by a circular rim supported by said plurality of yielding spokes, and by an O-ring supported by said circular rim and projecting outwardly from the latter, said O-ring being made with a material defining said first coefficient of friction.

5. A method for aligning and feeding a document, comprising the steps of:

providing an aligning and feeding device as defined by any of the claims from 1 to 4, providing loading means for selectively applying a first load and a second load, greater than said first load, to said at least one couple of rollers, aligning said document against said stopping means, while having said first aligning position, by applying said first load to said at least one couple of rollers through said loading means, and feeding said document beyond said stopping means, while in said second feeding position, by applying said second load to said at least one couple of rollers through said loading means.

* * * * *